US006288320B1

(12) United States Patent
Murakami et al.

(10) Patent No.: US 6,288,320 B1
(45) Date of Patent: Sep. 11, 2001

(54) ELECTRIC MUSICAL INSTRUMENT

(75) Inventors: Kazuo Murakami; Hideo Suzuki, both of Hamamatsu (JP)

(73) Assignee: Yahama Corporation (JP)

( * ) Notice: Subject to any disclaimer, the term of this patent is extended or adjusted under 35 U.S.C. 154(b) by 0 days.

(21) Appl. No.: 09/510,848

(22) Filed: Feb. 23, 2000

(30) Foreign Application Priority Data

Feb. 26, 1999 (JP) ..... 11-051551
Sep. 29, 1999 (JP) ..... 11-275828

(51) Int. Cl.[7] ..... G10H 1/06; G10H 7/00

(52) U.S. Cl. ..... 84/622; 84/600; 84/624; 84/625; 84/659; 84/660; 84/723; 84/735

(58) Field of Search ..... 84/600–604, 615–616, 84/622–627, 653–654, 659–660, 662–663, 692–694, 701–702, 723–726, 730–731, 735, 737–738, DIG. 24

(56) References Cited

U.S. PATENT DOCUMENTS

| | | | | |
|---|---|---|---|---|
| 4,171,659 | * | 10/1979 | Tumminaro | 84/723 |
| 4,805,510 | | 2/1989 | DeDianous . | |
| 5,038,662 | | 8/1991 | Ho . | |
| 5,117,730 | | 6/1992 | Yamauchi . | |
| 5,350,881 | | 9/1994 | Kashio . | |
| 5,438,157 | * | 8/1995 | Lace, Sr. et al. | 84/726 |

FOREIGN PATENT DOCUMENTS

| | | |
|---|---|---|
| 62-278595 | 12/1987 | (JP) . |
| 1-77698 | 5/1989 | (JP) . |
| 04-093997 | 3/1992 | (JP) . |
| 06-095672 | 4/1994 | (JP) . |
| 6-25892 | 9/1994 | (JP) . |

OTHER PUBLICATIONS

Article entitled "Measurements of sound pressure in the mouthpiece and two–dimensional displacement of artificial lips blowing a trumpet" by Fumiaki Ehara, Keinosuke Nagai and Koichi Mizutani of Institute of Applied Physics, University of Tsukuba.

Article entitled "The Bouncing Bow: An Experimental Study" by Anders Askenfelt of Royal Institute of Technology and Knut Guettler of Norwegian State Academy of Music published in CASJ vol. 3. No. 6 (Series II), Nov. 1998.

* cited by examiner

*Primary Examiner*—Marlon T. Fletcher
(74) *Attorney, Agent, or Firm*—Morrison & Foerster

(57) ABSTRACT

An electric musical instrument is provided, which enables rich and diverse expressions to be achieved in musical performance. A driving member drives a tone generating source. A driving member-side signal generator obtains a signal from the driving member and outputs the obtained signal. A musical tone signal generator generates a musical tone signal using the signal output by the driving member-side signal generator and outputs the generated musical tone signal. In another aspect of the invention, a tone generating source-side signal generator obtains a tone generating source-side signal from the tone generating source and outputs the obtained signal, and a driving member-side signal generator obtains a driving member-side signal from the driving member and outputs the obtained signal. A modulation device frequency-modulates one of the tone generating source-side signal and the driving member side signal with the other signal. The modulated signal is output from the modulation device as a sound.

31 Claims, 10 Drawing Sheets

MAIN BODY-SIDE VIBRATION SIGNAL

BOW-SIDE VIBRATION SIGNAL

OUTPUT SIGNAL FROM
SIGNAL PROCESSOR 103

MAIN BODY-SIDE VIBRATION SIGNAL

BOW-SIDE VIBRATION SIGNAL

OUTPUT SIGNAL FROM
SIGNAL PROCESSOR 103'

ELECTRIC MUSICAL INSTRUMENT

BACKGROUND OF THE INVENTION

1. Field of the Invention

The present invention relates to an electric musical instrument, and more particularly to an electric musical instrument such as an electric violin in which a tone generating source such as strings is driven by a driving member such as a bow to carry out musical performance.

2. Prior Art

Conventionally, there have been provided several types of electric violin in which vibration of strings produced by a rubbing or twanging action with a bow is detected with a pickup embedded in a bridge, and a musical tone signal is generated from the detected signal. There has been also provided another type of electric violin which is constructed such that a microphone is arranged in a resonating belly that constitutes a main body of the violin, and an electric signal output from the microphone is subjected to some processing to be output as a musical tone signal.

The conventional electric violins as described above are constructed such that vibration of strings produced by a rubbing action with the bow is detected via the bridge by the pickup, or vibration due to resonance of the resonating belly is detected by the microphone. Thus, the vibration detected by the pickup or the microphone is not vibration of the strings themselves, but vibration after being subjected to a filtering action effected by the bridge and the resonating belly. As a result, musical tones generated from the detected vibration are slow in rise time, and have higher harmonic components cut off. This leads to a problem that a player finds it difficult to achieve rich and diverse expressions as he or she intends to exhibit in musical performance. This problem is not limited to rubbed string instruments such as a violin, but common to all electric musical instruments, including wind instruments and percussion instruments, in which musical tones are generated by an interaction of a tone generating source (strings, pad, mouth-piece or the like) with a driving member (bow, stick, reed or the like) for driving the same.

SUMMARY OF THE INVENTION

It is an object of the present invention to provide an electric musical instrument which has solved the above-mentioned problem and which enables rich and diverse expressions to be achieved in musical performance.

To attain the above object, according to a first aspect of the present invention, there is provided an electric musical instrument comprising a tone generating source, a driving member that drives the tone generating source, a driving member-side signal generator that obtains a signal from the driving member and outputs the obtained signal, and a musical tone signal generator; wherein the musical tone signal generator generates a musical tone signal using the signal output by the driving member-side signal generator and outputs the generated musical tone signal.

With the above construction, besides musical tones obtained from the tone generating source, musical tones obtained from the driving member can be output, to thereby enable rich and diverse expressions to be achieved in musical performance.

Preferably, the electric musical instrument according to the first aspect further comprises an electronic tone generator that outputs an electronic tone generator musical tone signal specified by at least one of the signal obtained from the tone generating source and the signal output by the driving member-side signal generator.

In a preferred form of the first aspect, the musical tone signal generator comprises a mixing device that mixes the signal obtained from the tone generating source and the signal output by the driving member-side signal generator, to thereby form the musical tone signal.

With this construction, features of musical tones obtained from the driving member can be applied to musical tones obtained from the tone generating source or musical tones obtained from the electronic tone generator.

In a preferred form of the first aspect, the musical tone signal generator comprises a mixing device that mixes the signal obtained from the tone generating source, the signal output by the driving member-side signal generator and the electronic tone generator musical tone signal output by the electronic tone generator, to thereby form the musical tone signal.

Preferably, the musical tone signal generator comprises a selector that selects one of the signal obtained from the tone generating source and the signal output by the driving member-side signal generator, to thereby form the musical tone signal.

Alternatively, the musical tone signal generator comprises a selector that selects at least one of the signal obtained from the tone generating source, the signal output by the driving member-side signal generator and the electronic tone generator music tone signal output by the electronic tone generator, to thereby form the musical tone signal.

With these constructions, musical tones obtained from the tone generating source, musical tones obtained from the driving member, or musical tones obtained from the electronic tone generator can be selectively output, to thereby enable musical tones suited to a user's taste to be output.

Preferably, the musical tone signal generator comprises a modulation device that modulates the signal obtained from the tone generating source with the signal output by the driving member-side signal generator, to thereby form the musical tone signal.

With this construction, features of musical tones obtained from the driving member can be applied to musical tones obtained from the tone generating source.

Preferably, the electric musical instrument according to the first aspect further comprises a vibration generating device that generates vibration corresponding to at least one of the signal obtained from the tone generating source and the signal output by the driving member-side signal generator, and a tone generating member that resonates with the vibration generated by the vibration generating device, to thereby produce musical tones.

With this construction, a member played by a player and a resonant member (tone generating member) that generates musical tones corresponding to the player's performance can be arranged physically separately from each other, to thereby enable performance of the electric musical instrument in various manners.

In a preferred form of the first aspect, the electric musical instrument further comprises a memory, and a writing device that writes time change of at least one of the signal obtained from the tone generating source and the signal output by the driving member-side signal generator into the memory.

With this construction, a time change in the signal stored in the memory can be analyzed to evaluate the performance. In particular, the signal obtained from the driving member-side signal generator can reflect the delicate action of a player more accurately. Therefore, by analyzing the signal, accurate evaluation of the performance, in particular evaluation of the bowing action, is possible. Further, by analyzing the signal obtained from the driving member-side signal generator, evaluation of the player's performance action using the driving member is also possible.

To attain the above object, according to a second aspect of the present invention, there is provided an electric musical instrument comprising a tone generating source, a driving member that drives the tone generating source, a tone generating source-side signal generator that obtains a tone generating source-side signal from the tone generating source and outputs the obtained signal, a driving member-side signal generator that obtains a driving member-side signal from the driving member and outputs the obtained signal, a modulation device that frequency-modulates one of the tone generating source-side signal and the driving member side signal with the other of the tone generating source-side signal and the driving member-side signal and outputs the modulated signal, and an output device that outputs the modulated signal output from the modulation device as a sound.

With the above construction, musical tones can be output which reflect the driving member-side signal produced in the driving member in addition to the tone generating source-side signal produced in the tone generating source. Therefore, compared with the conventional electric musical instrument such as electric violin, richer and more diverse expressions can be achieved in musical performance.

Preferably, the modulation device comprises a memory that stores one of the tone generating source-side signal and driving member-side signal, and a reading device that generates an address signal based on the other of the tone generating source-side signal and driving member-side signal, and reads out the signal stored in the memory at an address designated by the address signal.

Also preferably, the electric musical instrument according to the second aspect further comprises a first mixing device that mixes the tone generating source-side signal and the driving member-side signal and outputs the mixed signal, and a second mixing device that mixes the mixed signal output from the first mixing device and the modulated signal output from the modulation device and outputs the mixed signal, and wherein the output device outputs the mixed signal output from the second mixing device as a sound.

To attain the above object, according to a third aspect of the present invention, there is provided an electric musical instrument comprising a tone generating source, a driving member that drives the tone generating source, a tone generating source-side signal generator that obtains a signal from the tone generating source and outputs the obtained signal, a driving member-side signal generator that obtains a signal from the driving member and outputs the obtained signal, a multiplier that multiplies the signal output from the tone generating source-side signal generator and the signal output from the driving member-side signal generator and outputs a signal indicative of the resulting product, and an output device that outputs the signal output from the multiplier as a sound.

With this construction, the tone generating source-side signal is output after being multiplied by the driving member-side signal. As a result, compared with the conventional electric musical instrument in which musical tones are output based solely on the tone generating source-side signal, richer and more diverse expressions can be achieved in musical performance.

Preferably, the electric musical instrument according to the third aspect further comprises a first mixing device that mixes the signal output from the tone generating source-side signal generator and the signal output from the driving member-side signal generator and outputs the mixed signal, and a second mixing device that mixes the mixed signal output from the first mixing device and the signal output from the multiplier and outputs the mixed signal, and wherein the output device outputs the mixed signal output from the second mixing device as a sound.

The above and other objects, features, and advantages of the present invention will be more apparent from the following detailed description taken in conjunction with the accompanying drawings.

DETAILED DESCRIPTION OF THE PREFERRED EMBODIMENTS

The present invention will now be described in detail with reference to the drawings showing embodiments thereof. In the following embodiments, the present invention is applied to an electric violin as an electric musical instrument.

Figure 1:
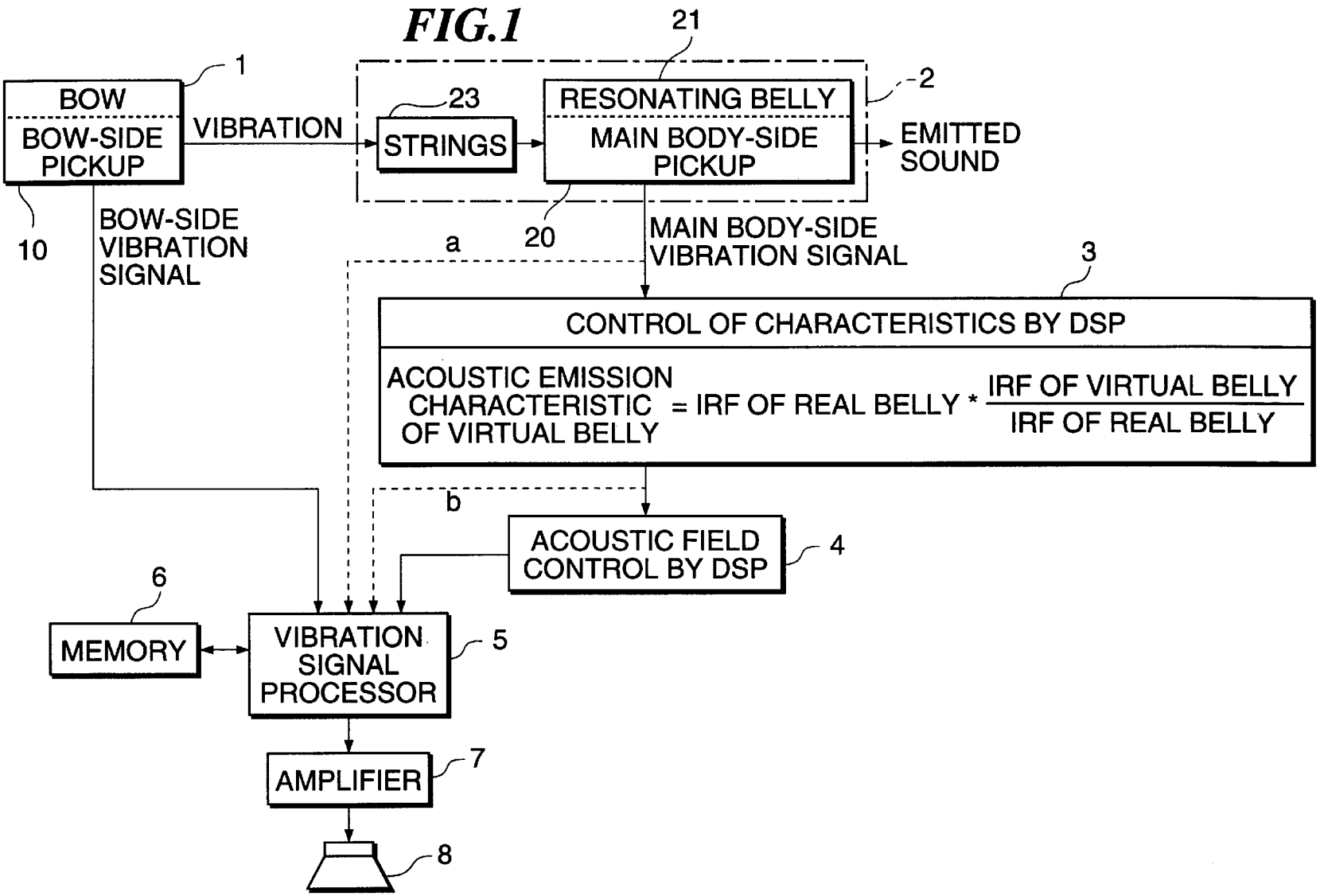
FIG. 1 is a block diagram showing the entire construction of an electric violin as an electric musical instrument according to a first embodiment of the present invention.

FIG. 1 shows the entire construction of an electric violin according to a first embodiment of the present invention. As shown in the figure, the electric violin is comprised of a bow (driving member) 1, a main body 2, Digital Signal Processors (DSPs) 3 and 4, a vibration signal processor 5, a memory 6, an amplifier 7, and a loudspeaker 8. As in the case of a violin as a natural musical instrument (hereinafter referred to as "natural violin"), a player plays the electric violin by rubbing strings 23 of the main body 2 with the bow 1.

Figure 2A:
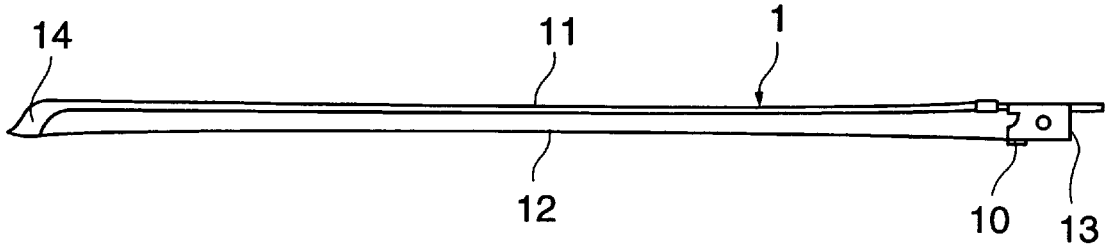
FIG. 2A is a plan view showing the construction of a bow which can be used in the first embodiment.

FIG. 2A is a plan view showing the construction of the bow 1 of the electric violin according to the present embodiment. The bow 1 serves as a driving member for causing the strings 23 (which serves as a tone generating source) of the main body 2 to vibrate. As shown in the figure, the bow 1 is generally comprised of a bow stick 11, a bow hair 12, and a frog 13. The frog 13, which is of generally rectangular parallelepiped shape, is secured to one end of the stick 11, and the bow hair 12 is supported under tension between a tip 14 (which is the other end of the stick 11) and the frog 13. The above described construction is the same with a bow of a natural violin. The bow 1 of the electric violin according to the present embodiment differs in that besides the above described components, a bow-side pickup 10 (driving member-side signal generator) is provided.

Figure 2B:
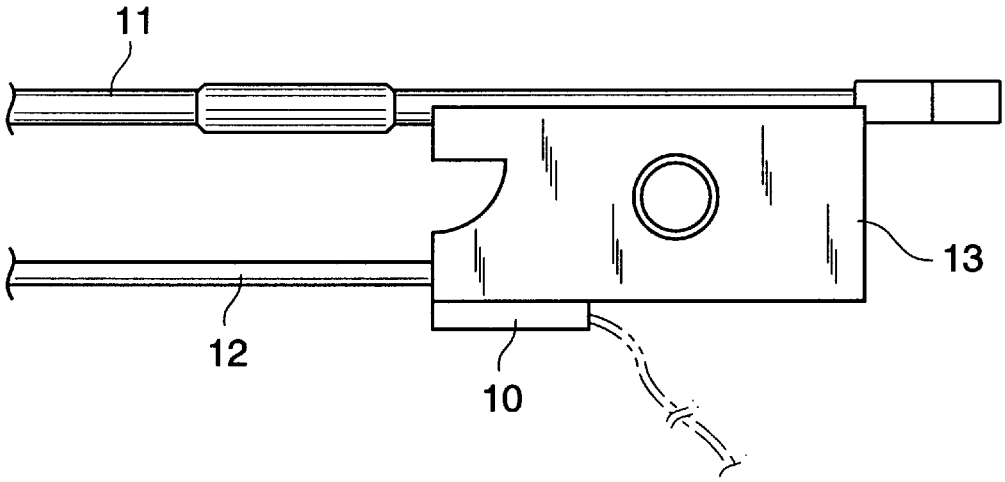
FIG. 2B is an enlarged view showing a frog of the bow of FIG. 2A and its vicinity.

FIG. 2B is an enlarged view of the frog 13 of the bow 1 shown in FIG. 2A and its vicinity. As shown in FIG. 2B, the bow 1 according to the present embodiment is constructed such that the bow-side pickup 10 is mounted on a side wall of the frog 13 at a location near the bow hair 12. The bow-side pickup 10 may be, for example, an acceleration pickup composed of a piezo electric element. When a player rubs the strings 23 supported under tension on the main body 2 with the bow 1, vibration is also produced in the bow hair 12, and propagated to the bow-side pickup 10. The bow-side pickup 10 generates and outputs an electric signal (hereinafter referred to as "bow-side vibration signal") in response to this vibration. Alternatively to the above-mentioned acceleration pickup, any other type of pickup, for example, a velocity pickup or a displacement pickup, or a force gauge for detecting a force may be used as the bow-side pickup, insofar as a vibration signal corresponding to the vibration produced in the bow can be generated.

Figure 3A:
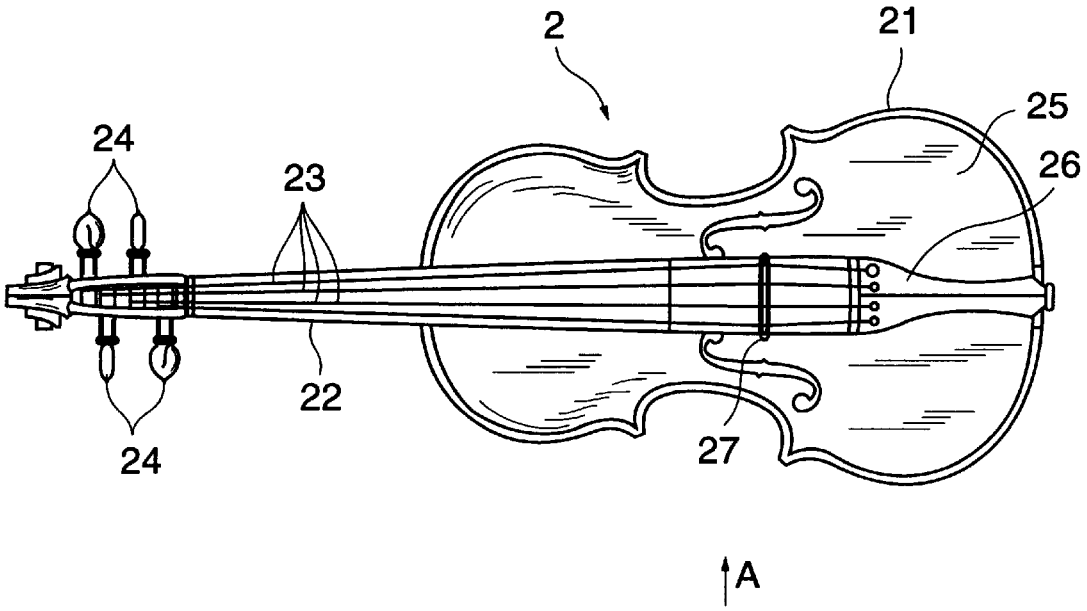
FIG. 3A is a plan view showing the appearance of a main body of the electric violin according to the first embodiment.

FIG. 3A is a plan view showing the appearance of the main body 2 of the electric violin according to the present embodiment. As shown in the figure, the main body 2 is comprised of a resonating belly 21 which is in the shape of a hollow box, a neck 22 extending from the resonating belly 21 and fixed thereto, and four strings 23 (tone generating source). The four strings 23 are supported under tension by pegs 24 provided near a distal end of the neck 22 and a tail piece 26 fixed to a table 25 constituting the resonating belly 21. A bridge 27 is sandwiched between the table 25 and the strings 23 such that vibration produced in the strings 23 is transmitted via the bridge 27 to the resonating belly 21. The vibration thus transmitted induces resonance in the resonating belly 21.

Figure 3B:
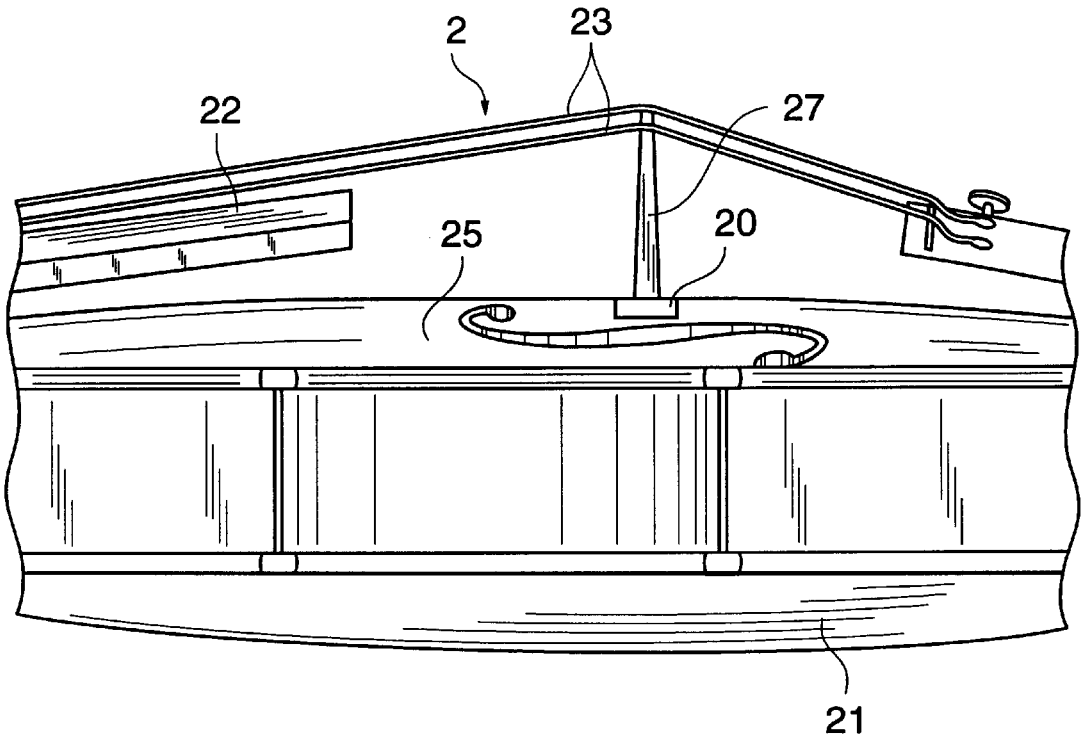
FIG. 3B is an enlarged side view showing a bridge of the main body and its vicinity.

FIG. 3B is an enlarged side view showing the bridge 27 of the main body 2 of the electric violin of FIG. 3A and its vicinity as viewed from the direction of the arrow A in FIG. 3A. As shown in FIG. 3B, the main body 2 has a main body-side pickup 20 embedded therein at a location where the bridge 27 is in contact with the table 25 of the resonating belly 21. This main body-side pickup 20 may be an acceleration pickup similar to the above-mentioned bow-side pickup 10. Upon receiving the vibration transmitted via the bridge 27 from the strings 23 and vibration caused by the resonance of the resonating belly 21, the pickup 20 generates and outputs a vibration signal (hereinafter referred to as "main body-side vibration signal") corresponding to the vibrations. The location where the main body-side pickup is mounted on the main body 2 is not limited to that shown in FIG. 3B. The pickup 20 may be mounted at a location where it will be in contact with the neck 22 or the resonating belly 21 so as to detect vibration transmitted from the strings 23 via the bridge 27 to the neck 22 or the resonating belly 21.

As described later, the electric violin of the present embodiment is constructed such that the DSP 3 adds the frequency characteristic of a resonating belly of a natural violin to the main body-side vibration signal. Therefore, the resonating belly 21 of the electric violin according to the present embodiment is not required to have a frequency characteristic similar to that of a resonating belly of a natural violin, and may be constructed differently (for example, of a smaller size) from a resonating belly of a natural violin. In this case, of course, even when the pickup-electroacoustic system is not operated, the main body of the electric violin can generate musical tones in a relatively small sound volume.

Referring again to FIG. 1, the DPS 3 performs an operation as expressed by the equation appearing in FIG. 1 on the main body-side vibration signal output from the main body-side pickup 20. More specifically, by this operation, the DSP 3 performs a simulation of a virtual belly representing a resonating belly of a natural violin. That is, from the main body-side vibration signal which is obtained via the main body-side pickup 20 and is accompanied by the frequency characteristic of the real belly (resonating belly 21), the DSP 3 cancels the frequency characteristic of the real belly, and generates and outputs a main body-side vibration signal to which only the frequency characteristic of a virtual belly representing a resonating belly of any desired natural violin has been applied. In the equation in FIG. 1, IRF (Inverted Filter) means the reciprocal of the transfer function of the real belly or the virtual belly.

The electric violin may be constructed such that, as shown by the broken line a in FIG. 1, the main body-side vibration signal output from the main body-side pickup 20 is selectively delivered either to the DSP 3 or directly to the vibration signal processor 5 or to both the DSP 3 and the signal processor 5, depending on instructions from a user.

The DSP 4 performs a predetermined operation on the main body-side vibration signal output from the DSP 3 to simulate a desired acoustic field. More specifically, the DSP 4 adds acoustic field characteristics simulating a concert hall, a church, a live house or the like to the supplied main body-side vibration signal, and outputs it. The electric violin of the present embodiment may be constructed such that, as shown by the broken line b in FIG. 1, the main body-side vibration signal from the DSP 3 is selectively output, depending on instructions from a user, either to the DSP 4 or to the vibration signal processor 5, or to both the DSP 4 and the vibration signal processor 5. When the electric violin is so constructed that the signal supplied to the vibration signal processor 5 can be selectively switched in response to instructions from a user, it provides the advantage that the electrical violin can produce musical sounds of various tone colors according to the user's taste so that he or she can enjoy more diverse manners of musical performance.

The vibration signal processor 5 mixes the bow-side vibration signal and the main body-side vibration signal, and outputs the mixed signal. The vibration signal processor 5 is adapted to change the mixing ratio of the bow-side vibration signal and the main body-side vibration signal in response to instructions from a user. Thus, the user can also select only one of the bow-side vibration signal and the main body-side vibration signal and output the selected one. The vibration signal processor 5 is adapted to write the signal waveform of one or both of the bow-side vibration signal and the main body-side vibration signal into a memory 6 in response to instructions from a user.

An amplifier 7 amplifies an output signal from the vibration signal processor 5 and outputs the amplified signal. The signal that is amplified by the amplifier 7 is output from the loudspeaker 8. Instead of the loudspeaker 8 as shown in FIG. 1, a headphone may be used.

Next, the operation of the electric violin according to the present embodiment will be explained.

When a player rubs the strings 23 with the bow 1, the strings 23 vibrate in response to the rubbing action. Vibration produced in the strings 23 is transmitted via the bridge 27 to the resonating belly 21, thereby inducing resonance in the resonating belly 21. Consequently, the table 25 of the resonating belly 21 receives the vibration transmitted from the strings 23 via the bridge 27 and vibration due to the resonance of the resonating belly 21. The main body-side pickup 20 detects the vibrations thus produced on the table 25, and generates the main body-side vibration signal which is an electric signal having a waveform similar to that of the vibrations on the table 25, and outputs it to the DSP 3. A musical sound is emitted by the resonance of the resonating belly 21. This emitted sound may be cancelled by a sound volume control device, not shown.

The DSP 3 performs an operation expressed by the equation in FIG. 1 on the supplied main body-side vibration signal, and outputs the resulting signal. As described above, this operation cancels the frequency characteristic of the resonating belly 21 (real belly) of the main body 2 from the main body-side vibration signal, and at the same time adds the frequency characteristic of a resonating belly (virtual belly) of a natural violin to the main body-side vibration signal. In this way, the musical sound which is output from the loudspeaker 8 based on the main body-side vibration signal can closely approximate the musical sound of a natural violin.

The DSP 4 adds predetermined acoustic field characteristics to the main body-side vibration signal output from the DSP 3, and outputs the resulting signal to the vibration signal processor 5.

On the other hand, with the above described string rubbing action, the bow hair 12 stretched under tension along the bow 1 also vibrates. The bow-side pickup 10 generates the bow-side vibration signal which is an electric signal having a waveform similar to that of the vibration of the bow 1, and outputs it to the vibration signal processor 5. A musical tone signal having the same pitch (height of tone) as the vibration of the strings is thereby obtained.

The vibration signal processor 5 mixes the bow-side vibration signal supplied from the bow-side pickup 10 and the main body-side vibration signal supplied from the DSP 4 in a mixing ratio designated by the user, and outputs the mixed vibration signal. In the case where the main body-side vibration signal is also supplied directly from the main body-side pickup 20 or from the DSP 3, as shown by the broken line a and b in FIG. 1, the vibration signal processor 5 mixes the bow-side vibration signal supplied from the bow-side pickup 10 and the main body-side vibration signal supplied from the main body-side pickup 20 or from the DSP 3 or from the DSP 4, and outputs the mixed vibration signal.

When the user operates an operating unit (switches and the like), not shown, to give instructions to store the waveform of the vibration(s), the vibration signal processor 5 writes a time change or changes of one or both of the entered bow-side vibration signal and main body-side vibration signal successively into the memory 6.

The output signal from the vibration signal processor 5 is amplified by the amplifier 7, and is output from the loudspeaker 8. Since the bow-side vibration signal and the main body-side vibration signal have approximately the same pitch, musical tones which are output after mixing these two signals are a harmonious mixture of musical tones from the bow-side vibration signal and from the main body-side vibration signal.

In the operation of the electric violin described above, the vibration produced in the strings 23 is transmitted via the bridge 27 to the resonating belly 21 where it induces resonance, so that the vibration is filtered. Musical tones which are output based on the main body-side vibration signal from the main body-side pickup 20 have therefore higher harmonic components thereof attenuated into a small amount, and hence have relatively slow attack portions. In contrast, the bow-side vibration signal output from the bow-side pickup 10 is not filtered. Therefore, compared with the above described musical tones which are output based on the main body-side vibration signal, musical tones which are output based on the bow-side vibration signal have rich higher harmonic components, and are thus stimulating musical tones having sharp attack portions.

As described above, according to the present embodiment, in addition to the vibration signal corresponding to the vibration produced in the strings, the vibration signal corresponding to the vibration produced in the bow 1 can be utilized in musical performance. As a result, compared with the conventional electric violin in which musical tones are output based only on the main body-side vibration signal, richer and more diverse expressions can be achieved in musical performance.

Further, since the mixing ratio of the bow-side vibration signal and the main body-side vibration signal can be adjusted as desired, the electric violin can produce musical tones that best suit a user's taste.

Moreover, the waveform of the vibration signal stored in the memory 6 may be utilized to evaluate the performance of a player, for example, by performing FFT analysis or the like. Particularly, the bow-side vibration signal can reflect the delicate action of a player more accurately than the main body-side vibration signal which has been subjected to filtering by the bridge 27 and the resonating belly 21. Therefore, by analyzing the bow-side vibration signal, accurate evaluation of the performance, in particular evaluation of the bowing action, is possible.

Although in the above described embodiment, the electric violin is constructed such that the waveforms of the vibration signals can be written into the memory, the invention is not limited to this construction, but the electric violin may be constructed such that only the pitch (height of tone) of each vibration signal is detected and written into the memory.

The foregoing description of the first embodiment of the present invention is only illustrative, and various modifications or variations may be made to the above described embodiment without departing from the spirit and scope of the invention. For example, the following variations are possible.

It is to be understood that although in the above described embodiment the present invention is applied to an electric violin, the invention is not limited to this application, but may equally be applied to any other musical instrument in which strings are caused to vibrate using a bow, such as viola, cello, and contrabass.

Further, the present invention is not limited to musical instruments in which strings is caused to vibrate using a bow to produce musical tones, but may equally be applied to any other musical instrument in which a tone generating source is driven using some driving member to produce musical tones. For example, the invention may be applied to a drum in which vibration is generated by striking a pad (tone generating source) with a stick (driving member). Then, the drum may be constructed such that besides musical tones from vibration of the pad, vibration of the stick is also detected and musical tones corresponding to the detected vibration are output. The present invention may be applied to a saxophone or a clarinet in which a mouth piece (tone generating source) is caused to vibrate using a reed (driving member). Then, the musical instrument may be so constructed that besides musical tones from vibration produced in the mouth piece, vibration of the reed is also detected and musical tones corresponding to the detected vibration are output.

Thus, the term "driving member" as used in the appended claims includes various means such as a bow, a stick, and a reed for producing vibration in a tone generating member, and the term "tone generating source" includes various members such as a string, a pad, and a mouth piece as described above, which is driven by the driving member.

The electric violin of the above described embodiment is constructed such that the vibration signals which are output from the bow-side pickup 10 and the main body-side pickup 20 are mixed in the vibration signal processor 5. But, the electric violin may also be constructed such that a MIDI signal related to pitch or sound volume is generated from at least one of these vibration signals, and output to an electronic tone generator. In this case, the vibration signal processor 5 may be constructed so as to mix three outputs from the bow-side pickup 10, the main body-side pickup 20, and the electronic tone generator in a desired ratio.

Alternatively, the electric violin may be constructed as follows: An actuator that converts an electric signal into vibration is provided on a box having a shape similar to that of a resonating belly of a natural violin. The actuator is connected by a signal line to the bow-side pickup 10 and the main body-side pickup 20. One or both of the vibration signals output from the bow-side pickup and the main body-side pickup are fed via the signal line to the above-mentioned actuator. In this way, a vibration similar to that produced in the bow or the strings is given to the box, and musical tones are generated from the resonance of the box induced by the vibration. Such a construction makes it possible to place the box for generating musical tones at a location physically separated from the bow and the strings with which a player plays the violin in musical performance, thereby providing diverse manners of performance. In other words, an electro-musical tone converter of violin-resonating belly type can be thus provided.

Although in the above described embodiment the electric violin is constructed such that the bow-side vibration signal output from the bow-side pickup 10 and the main body-side vibration signal output from the main body-side pickup 20 are mixed in the vibration signal processor 5, the electric violin may be alternatively constructed such that two loudspeakers are provided so as to output musical tones corresponding to the bow-side vibration signal from one of the loudspeakers and musical tones corresponding to the main body-side vibration signal from the other loudspeaker, respectively. In this case, it is also possible, as in the above described second variation, to construct the electric violin such that pitch information is detected from the bow-side vibration signal and used for driving a desired electronic tone generator to output musical tones from a loudspeaker.

Figure 4:
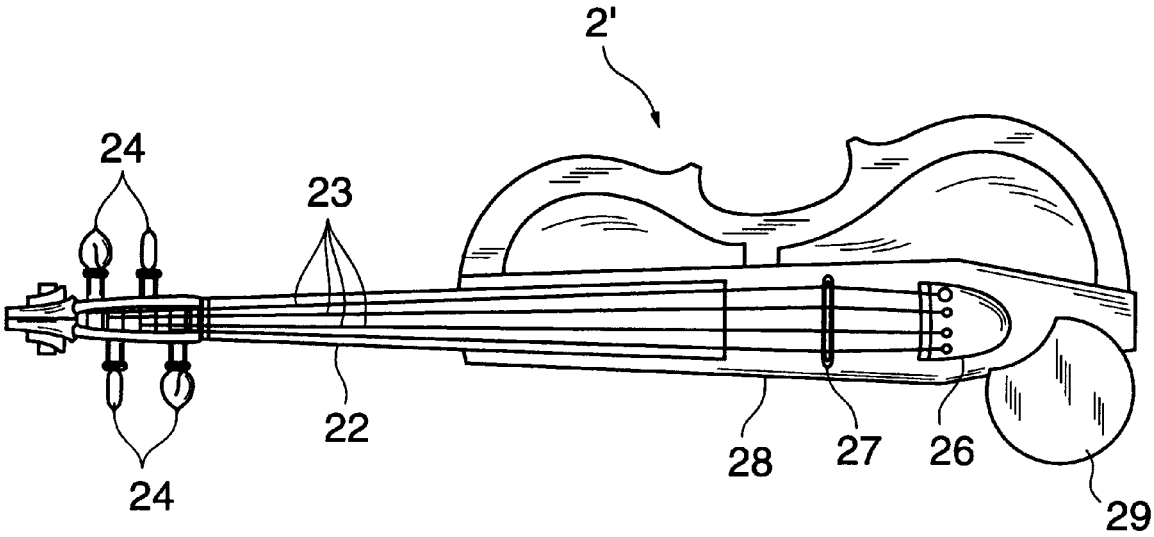
FIG. 4 is a plan view showing the construction of a main body of an electric violin according to a variation of the first embodiment.

In the above described embodiment, the main body of the electric violin has a resonating belly which is constructed differently from a resonating belly of a natural violin, and vibration from the strings is transmitted to the resonating belly to induce resonance therein. But, the main body of the electric violin may be constructed, for example, as shown in FIG. 4. In FIG. 4, elements and parts corresponding to those in FIG. 2 are designated by identical reference numerals, and description thereof is omitted.

As shown in FIG. 4, a main body 2' of the electric violin of this variation does not have the resonating belly 21 which is a hollow box as seen in the main body of the electric violin of FIG. 3, but has a plate-shaped body 28 that supports a neck 22 and a tail piece 26. On one side of the body 28, a plate member similar in shape to a resonating belly of a natural violin is provided to simulate the appearance of the resonance belly of the natural violin. On the other side of the plate member is provided a chin pad 29, not shown in FIG. 3A, for a player to support the main body 2' under his or her chin in musical performance.

With this construction, no resonance occurs as in the case of a natural violin or of the electric violin of the above described embodiment. Consequently, the frequency characteristic of the resonating belly is not included in the main body-side vibration signal output from the main body-side pickup as in the above described embodiment. While in the above described embodiment the frequency characteristic of the real belly is cancelled to be replaced by the frequency characteristic of a resonating belly of a natural violin, there is no need for the cancelling of the frequency characteristic of the real belly in this variation, and only the frequency characteristic of a natural violin has to be added to obtain the same effect as in the above described embodiment.

The resonating belly of the electric violin may be identical in shape to a resonating belly of a natural violin. In this case, musical tones from the main body-side vibration signal are exactly musical tones of the natural violin, thereby eliminating the need for provision of the DSP 3 in the above described embodiment.

The present invention is not limited to the construction of the above described embodiment that the bow-side vibration signal output from the bow-side pickup 10 and the main body-side vibration signal output from the main body-side pickup 20 are mixed and output from the vibration signal processor 5. For example, the main body-side vibration signal output from the main body-side pickup 20 may be modulated using the bow-side vibration signal from the bow-side pickup 10 in amplitude modulation or the like. The features of musical tones from the bow-side vibration signal can be thus added to musical tones from the main body-side vibration signal to realize richer and more diverse manners of performance.

As shown in FIG. 2A, the bow-side pickup 10 is arranged on a side wall of the frog 13 at a location near the bow hair 12 in the above described embodiment. But, the location of the bow-side pickup 10 is not limited to this location. For example, the bow-side pickup 10 may be arranged at a portion of the bow which a player grips in the string-rubbing action. The bow-side vibration signal output from the bow-side pickup 10 will change according to the manner in which the player grips or holds the bow, thereby enabling more diverse manners of performance.

The present invention is not limited to the construction of the above described embodiment that the mixing ratio in the vibration signal processor 5 can be set as desired by a user. The mixing ratio may be a fixed value. Then, if the mixing ratio is set, by way of example, as 1:4, a bright and stimulating tone color can be obtained.

According to the present embodiment, as described above, besides the vibration signal from the vibration which is produced in the strings and which is filtered via the bridge and the resonance in the belly, the vibration signal corresponding to the vibration produced in the bow can be utilized in the musical performance, thereby making it possible to achieve richer and more diverse expressions in musical performance than in the conventional electric violin. Further, a wide variety of information which has not hitherto been utilized in the conventional electric musical instrument, such as information concerning the performance method, can be obtained and utilized in musical performance.

Figure 5:
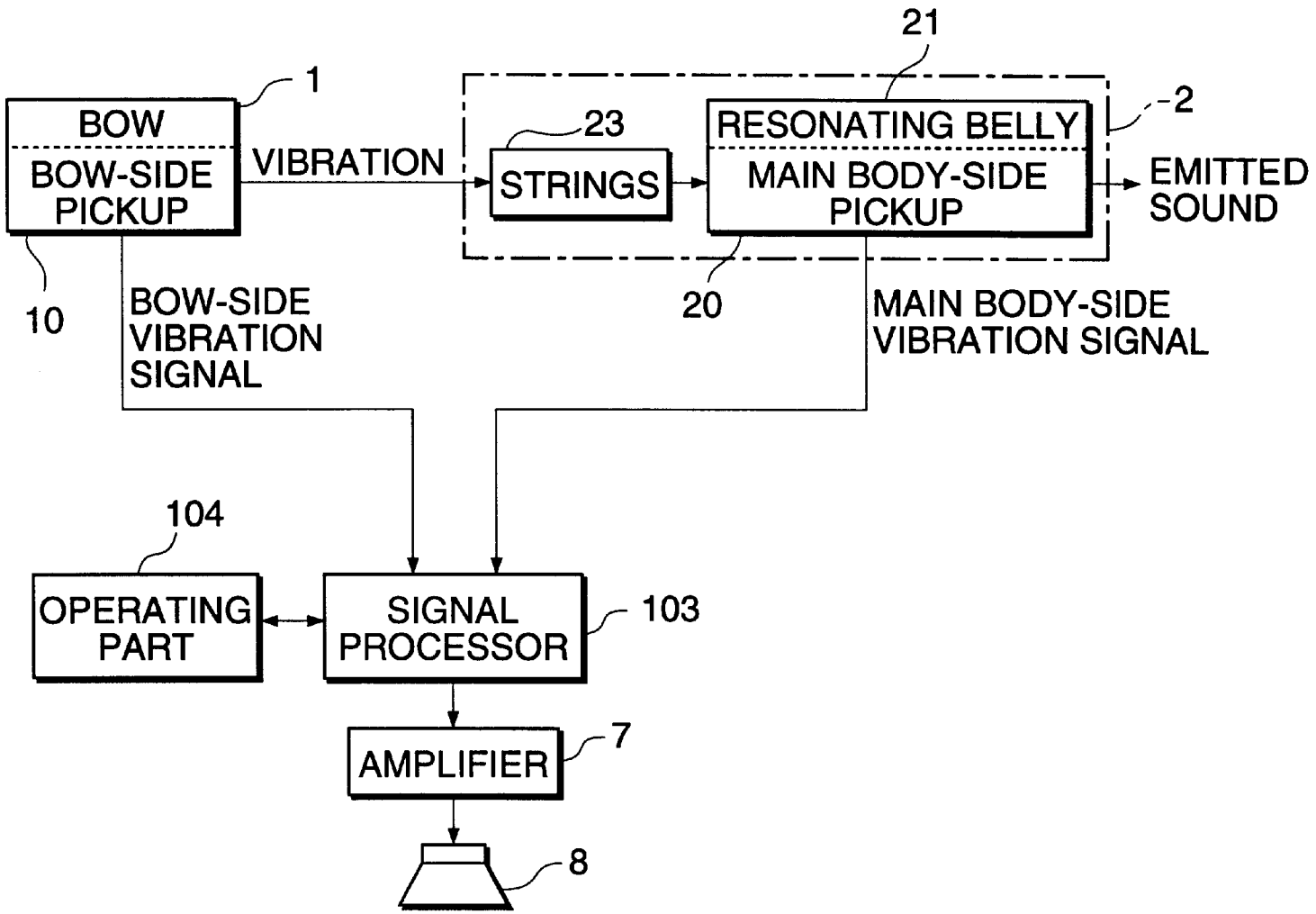
FIG. 5 is a block diagram showing the entire construction of an electric violin as an electric musical instrument according to a second embodiment of the present invention.

Next, a second embodiment of the present invention will be described with reference to FIG. 5. FIG. 5 shows the entire construction of an electric violin as an electric musical instrument according to the second embodiment. In FIG. 5, elements and parts corresponding to those in FIG. 1 are designated by identical reference numerals, detailed description of which is omitted. As shown in FIG. 5, the electric violin according to the second embodiment is comprised of a bow 1, a main body 2, a signal processor 103, an operation part 104, an amplifier 7, and a loudspeaker 8. A player of this electric violin plays the violin in the same manner as in an ordinary natural violin, by rubbing the strings 23 of the main body 2 with the bow 1, or the like.

The bow 1 and the main body 2 of the second embodiment are the same in construction and shape as those of the first embodiment shown in FIGS. 2A, 2B, 3A and 3B, and description thereof is omitted.

In FIG. 5, the signal processor 103 performs various processing on the main body-side vibration signal and the bow-side vibration signal, and outputs the resulting processed signal. In this embodiment, the signal processor 103 has a function of performing frequency modulation on the main body-side vibration signal using the bow-side vibration signal. The operation part 104 includes various keys and switches. By operating these keys and switches, a user can adjust various coefficients (parameters) used in the signal processor 103 as desired. An output signal from the signal processor 103 is amplified by the amplifier 7 and output from the loudspeaker 8. Instead of the loudspeaker 8 as shown in FIG. 5, a headphone may be used.

The construction of the signal processor 103 will now be described in detail with reference to FIG. 6.

Figure 6:
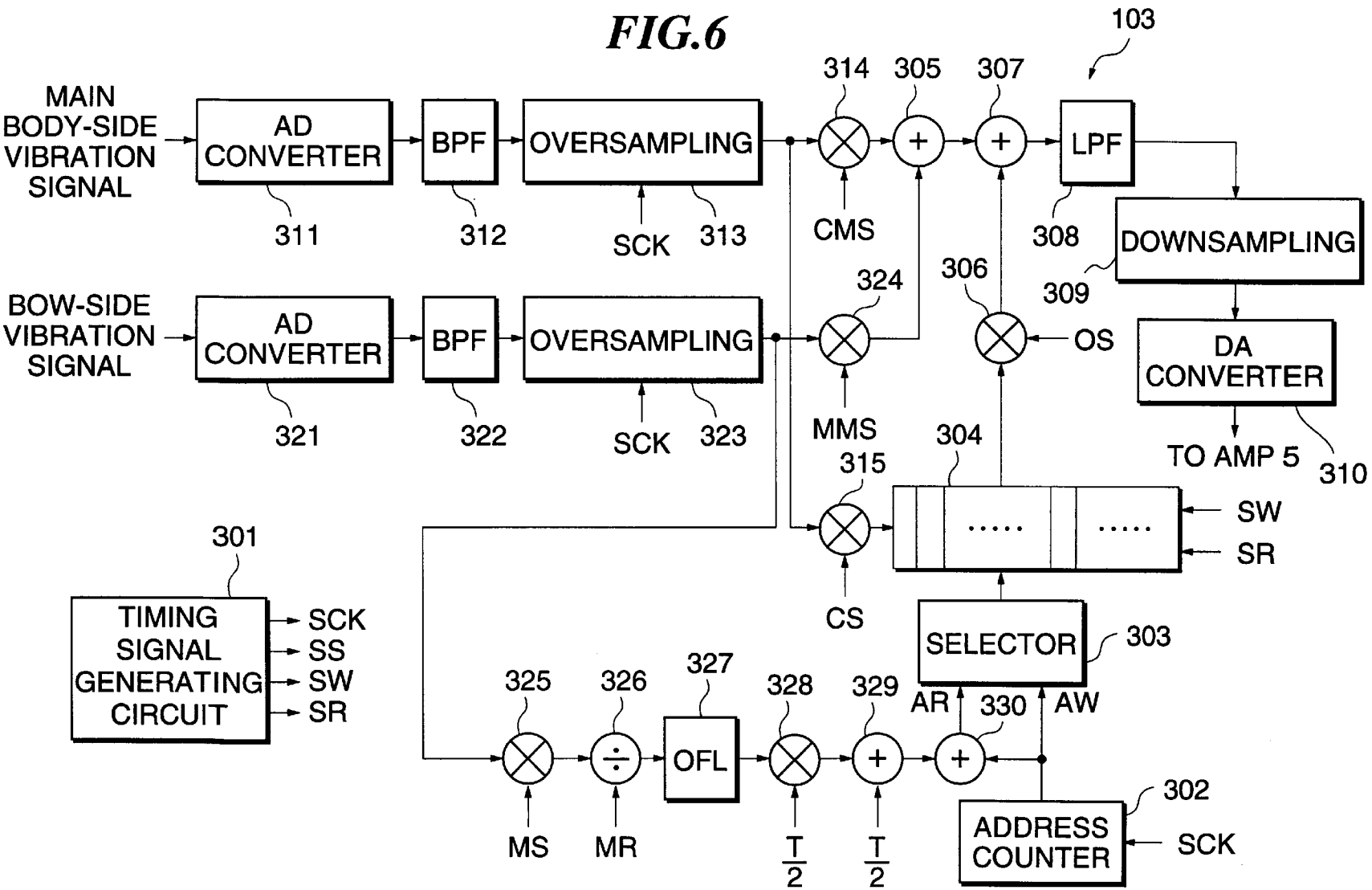
FIG. 6 is a block diagram showing the construction of a signal processor of the electric violin of FIG. 5.

As shown in FIG. 6, the signal processor 103 is comprised of a timing signal generating circuit 301, analog-to-digital (A/D) converters 311 and 321, band pass filters (BPFs) 312 and 322, oversampling circuits 313 and 323, a memory 304, an overflow limiter 327, a low pass filter (LPF) 308, a downsampling circuit 309, a digital-to-analog (D/A) converter 310, multipliers 314, 324, 315, 325, 328, and 306, adders 305, 307, 329, and 330, divider 326, an address counter 302, and a selector 303.

The timing signal generating circuit 301 is for generating and outputting various timing signals and clock signals. Signals generated by the timing signal generating circuit 301 will next be explained with reference to FIG. 7.

a. Sampling Clock Signal SCK

Figure 7:
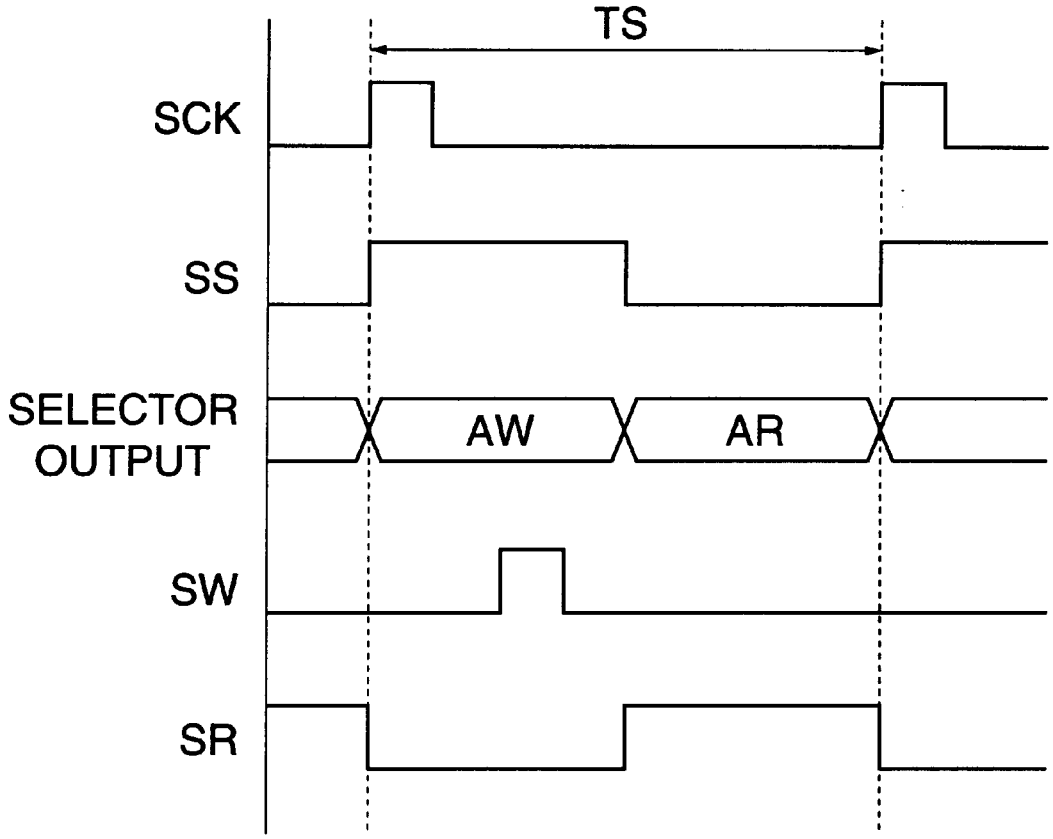
FIG. 7 is a timing chart showing, by way of example, level changes of signals generated by a timing generating circuit of the electric violin of FIG. 5.

Sampling clock signal SCK is supplied to the oversampling circuits 313 and 323 to designate timing of sampling. The sampling clock signal SCK is also supplied to the address counter 302. One period of the sampling clock signal as shown in FIG. 7 will be hereinafter referred to as the sampling period TS.

b. Selector Control Signal SS

Selector control signal SS is supplied to the selector 303. As shown in FIG. 7, the selector control signal SS is at a high (H) level in the first half of the above-mentioned sampling period TS, and at a low L) level in the second half of the sampling period TS.

c. Write Instruction Signal SW

Write instruction signal SW is supplied to the memory 304 to designate timing of writing data into the memory 304. As shown in FIG. 7, the writing instruction signal SW has a portion which is at H level in the first half of the sampling period TS.

d. Read Instruction Signal SR

Read instruction signal SR is supplied to the memory 304 to designate timing of reading out data from the memory 304. As shown in FIG. 7, the read instruction signal SR is at L level in the first half, and at H level in the second half of the sampling period TS.

Referring again to FIG. 6, the A/D converters 311 and 321 convert the entered main body-side vibration signal and bow-side vibration signal into digital signals at a predetermined sampling frequency, respectively. From the entered signals, the BPFs 312 and 322 each pass only frequency components contained in a predetermined frequency band. The oversampling circuits 313 and 323 sample output signals from the BPFs 312 and 322 in timing designated by the supplied sampling clock signal SCK. Here, the sampling clock signal SCK is set such that the sampling in the oversampling circuits 313 and 323 is performed at a higher sampling frequency than the sampling frequency of the A/D converters 311 and 321 (for example, at a frequency eight times as high as the sampling frequency of A/D converters 311 and 321).

The multipliers 314, 324, 325, 328, and 306 are each for multiplying the entered input signal by a predetermined coefficient and outputting the multiplied signal.

The multiplier 325, divider 326, overflow limiter 327, multiplier 328, and adders 329 and 330 are for generating a read address signal AR to designate the address in the memory 304 from which data are to be read out.

The multiplier 325 multiplies an output signal from the oversampling circuit 323 by a coefficient MS and outputs the resulting signal. Here, the coefficient MS is for determining the extent to which the bow-side vibration signal contributes to the frequency modulation. The divider 326 divides the entered data by a coefficient MR, and outputs the result to the overflow limiter 327. The overflow limiter 327 adjusts the data supplied from the divider 326 so as to limit the value of the data within "1"~"−1". More specifically, the overflow limiter 327 clips a signal component exceeding "1" to output "1", outputs a signal component falling between "−1" and "1" as it is, and clips a signal component less than "−1" to output "−1". The multiplier 328 multiplies an output signal from the overflow limiter 327 by a coefficient T/2 and outputs the result. The adder 329 adds the coefficient T/2 to this output signal and outputs the result.

The address counter 302 successively counts the sampling clock signal SCK output from the timing signal generating circuit 301, and outputs an address signal AW corresponding to the count value. Thus, the address signal AW changes in synchronization with the generating timing of the sampling clock signal SCK. The address signal AW is output to the selector 303 and the adder 330.

The adder 330 adds the address signal AW output from the address counter 302 and the signal output from the adder 329, and outputs the result as the read address signal AR.

The selector 303 selects, based on the selector control signal SS supplied from the timing signal generating circuit 301, either the address signal AW supplied from the address counter 302 or the read address signal AR supplied from the adder 330, and outputs the selected signal.

Data supplied from the multiplier 315 are successively written into the memory 304 in timing designated by the write instruction signal SW supplied from the timing signal generating circuit 301. On the other hand, the data that have been written into the memory 304 are successively read out in accordance with the read instruction signal SR supplied from the timing signal generating circuit 301. The address in the memory 304 for writing or reading out data is designated by the address signal AW or the read address signal AR supplied from the selector 303.

The multiplier 306 multiplies the data read out from the memory 304 by a coefficient OS and outputs the result. The adder 307 adds up output signals from the multipliers 305 and 306 and outputs the result.

The LPF 308 passes only frequency components under a cutoff frequency thereof from the supplied signal. Thus, frequency components which are unnecessary for musical tones can be eliminated. The downsampling circuit 309 samples an output signal from the LPF 308 at a sampling frequency lower than the sampling frequency of the above-mentioned oversampling circuit 313. An output signal from the downsampling circuit 309 is converted to an analog signal by the D/A converter 310 and output to the amplifier 7.

Next, the operation of the electric violin according to the present embodiment will be described.

When a player rubs the strings 23 with the bow 1, the strings 23 vibrate in response to the rubbing action. Vibration produced in the strings 23 is transmitted via the bridge 27 to the resonating belly 21, thereby inducing resonance in the resonating belly 21. Consequently, the table 25 of the resonating belly 21 receives the vibration transmitted from the strings 23 via the bridge 27 and vibration due to the resonance of the resonating belly 21. The main body-side pickup 20 detects the vibrations thus produced on the table 25, and generates the main body-side vibration signal which is an electric signal having a waveform similar to that of the vibrations on the table 25, and outputs it to the DSP 3. A musical sound is emitted by the resonance of the resonating belly 21. This emitted sound may be cancelled by a sound volume control device, not shown.

On the other hand, with the above described string rubbing action, the bow hair 12 stretched under tension along the bow 1 also vibrates. The bow-side pickup 10 generates the bow-side vibration signal which is an electric signal having a waveform similar to that of the vibration of the bow 1, and outputs it to the vibration signal processor 103.

The signal processor 103 performs frequency modulation on the bow-side vibration signal supplied from the bow-side pickup 10 with the main body-side vibration signal supplied from the main body-side pickup 20, and outputs the result. This will be described more in detail hereinbelow.

First, the main body-side vibration signal is converted by the A/D converter 311 to a digital signal at the predetermined sampling frequency, and the digital signal is supplied to the BPF 312. Only the frequency components contained in the predetermined frequency band are output from the BPF 312 to the oversampling circuit 313. The oversampling circuit 313 resamples the signal supplied from the BPF 312 in timing designated by the sampling clock signal SCK supplied from the timing signal generating circuit 301 (for example, in the timing of rise of the sampling clock signal SCK), and output the resampled signal. This output signal is supplied to the multipliers 314 and 315. The multiplier 314 multiplies the supplied signal by a coefficient CMS and outputs the result. The multiplier 315 multiplies the supplied signal by a coefficient CS and outputs the result to the memory 304.

On the other hand, the bow-side vibration signal is,converted to a digital signal by the A/D converter 321 at the predetermined sampling frequency, and the digital signal is supplied to the BPF 322. Only the frequency components contained in the predetermined frequency band are output from the BPF 322 to the oversampling circuit 323. The oversampling circuit 323 resamples the signal supplied from the BPF 322 in timing designated by the sampling clock signal SCK supplied from the timing signal generating circuit 301. Thus, the main body-side vibration signal and the bow-side vibration signal are resampled by the oversampling circuit 313 and the oversampling circuit 323, respectively, at a higher frequency. This is because the sampling frequency needs to be sufficiently high in order for higher harmonic components produced by the frequency modulation using the main body-side vibration signal and the bow-side vibration signal not to form folding noise.

The output signal from the oversampling circuit 323 is supplied to the multipliers 324 and 325. The multiplier 324 multiplies the supplied signal by a coefficient MMS and outputs the result. The adder 305 adds the output signal from this multiplier 324 and the output signal from the above-mentioned multiplier 314, and outputs the result to the adder 307. Thus, the above-mentioned coefficients CMS and MMS serve to determine the mixing level of the bow-side vibration signal and the main body-side vibration signal, respectively.

On the other hand, the multiplier 325 multiplies the supplied signal by the coefficient MS, and outputs the result to the divider 326. The divider 326 divides the supplied signal by the coefficient MR, and outputs the result. The output signal from the divider 326 is adjusted by the overflow limiter 327 so as to fall within the range of "1"~"−1". More specifically, when the data supplied from the divider 326 exceeds "1", the overflow limiter 327 outputs the data as "1", outputs the data as it is when the supplied data falls within the range of "−1"~"1", and outputs the data as "−1" when the data is less than "−1". The output signal from the overflow limiter 327 is multiplied by the coefficient T/2 by the multiplier 328, and added by the coefficient T/2 by the adder 329, and the result is output.

On the other hand, the address counter 302 successively counts the sampling clock signal SCK supplied from the timing signal generating circuit 301, and outputs the address signal AW corresponding to the count value. The address signal AW is supplied to the selector 303 and the adder 330. The adder 330 adds the output signal from the adder 329 and the address signal AW, and outputs the result to the selector 303.

The selector 303 selects and outputs either the address signal AW or the read address signal AR, depending on the signal level of the selector control signal SS. More specifically, it selects and outputs the address signal AW as long as the selector control signal SS at H level is supplied from the timing signal generating circuit 301. On the other hand, it selects and outputs the read address signal AR as long as the selector control signal at L level is supplied. As shown in FIG. 7, the selector control signal SS is at H level in the first half of the sampling period TS, and is at L level in the second half of the sampling period TS. Thus, as shown in FIG. 7, the address signal AW is output to the memory 304 in the first half of the sampling period TS, while in the second half of the sampling period TS the read address signal AR is output to the memory 304.

The above-mentioned output signal from the multiplier 315 is successively written into the memory 304 in accordance with the write instruction signal SW. On the other hand, the data written into the memory 304 are successively read out from the memory 304 in accordance with the read instruction signal SR. The data writing and reading operations will be described in detail hereinbelow.

a. Data Writing Operation

The signal supplied from the multiplier 315 is successively written into the memory 304 in timing designated by the write instruction signal SW. The address to which this data is written is designated by the output signal from the selector 303. This will be described in detail below.

As stated above, the selector 303 selects the address signal AW in the first half of the sampling period TS and outputs it to the memory 304. On the other hand, as shown in FIG. 7, the write instruction signal SW supplied to the memory 304 has a portion which is at H level in the first half of the sampling period TS. Consequently, the signal successively supplied to the memory 304 from the oversampling circuit 313 in accordance with the sampling clock signal SCK is successively written into the memory 304 at the address designated by the address signal AW in the first half of the sampling period TS.

b. Data Reading Operation

The data written into the memory 304 is successively read out in timing designated by the read instruction signal SR. The read address is designated by the signal supplied from the selector 303. This will be described in detail below.

As stated above, the selector 303 selects the address signal AR in the second half of the sampling period TS, and outputs it to the memory 304. On the other hand, the read instruction signal SR supplied to the memory 304 is in the second half of the sampling period TS, as shown in FIG. 7, is at H level. Consequently, in the second half of the sampling period TS, the information stored at the address designated by the read address signal AR is read out from the memory 304.

The read address signal AR is obtained by multiplying the output signal from the overflow limiter 327 ("1" to "−1") by the coefficient T/2, adding the coefficient T/2 to the result, and adding the address signal AW to the result. Thus, the address designated by this read address signal AR is an address determined in accordance with the bow-side vibration signal within a range which has a center thereof lying at an address separated by T/2 from the address designated by the address signal AW and which has a width designated by the coefficient T.

More specifically, if the output signal from the overflow limiter 327 is "1", the read address signal AR is $1\times T/2+T/2+AW=AW+T$ so that an address which is separated by T from the write address AW at that time point is designated. If the output signal from the overflow limiter 327 is "0", the read address signal AR is $0\times T/2+T/2+AW=AW+T/2$ so that an address which is separated by T/2 from the write address AW at that time point is designated. Likewise, if the output signal from the overflow limiter 327 is "−1", the read address signal AR is $(-1)\times T/2+T/2+AW=AW$ so that the same address as the write address AW at that time point is designated.

Consequently, the signal read out from the memory 304 is a signal which is obtained by frequency-modulating the main body-side vibration signal with the bow-side vibration signal. The coefficient MS in the multiplier 325 and the coefficient MR in the divider 326 determine the range of data clipped to "1" or "−1" by the overflow limiter 327. Therefore, it can be said that the coefficients MS and MR determine the depth of the frequency modulation.

The data read out from the memory 304 is multiplied by the coefficient OS by the multiplier 306, and the result is output to the adder 307. The adder 307 adds the output signal from the multiplier 306 and the output signal from the adder 305 (obtained by mixing the main body-side vibration signal and the bow-side vibration signal) and outputs the result.

The output signal from the adder 307 has high frequency components thereof cut off by the LPF 308, the cut-off frequency of which is lower than ½ of the sampling frequency of the downsampling circuit 309, described later, in order to avoid the occurrence of folding noise. The output signal from the LPF 308 is sampled by the downsampling circuit 309 at a sampling frequency lower than the sampling frequency of the oversampling circuit 313.

The output signal from the downsampling circuit 309 is converted to an analog signal by the D/A converter 310, and the analog signal is amplified by the amplifier 7 and output from the loudspeaker 8.

Figure 8A:
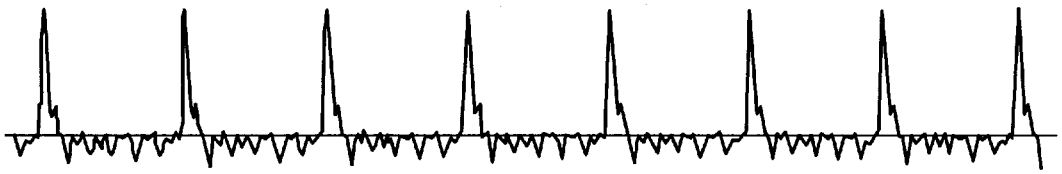
FIG. 8A is a view showing, by way of example, a waveform of a main body-side vibration signal generated by the electric violin of FIG. 5.
Figure 8B:
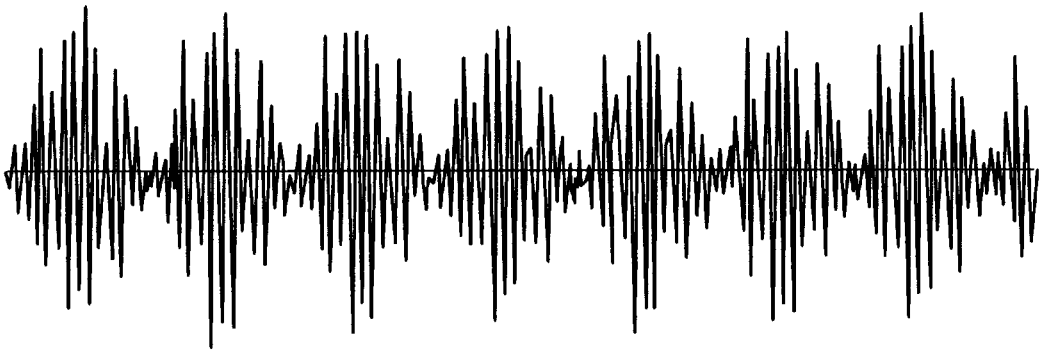
FIG. 8B is a view showing, by way of example, a waveform of a bow-side vibration signal generated by the electric violin of FIG. 5.
Figure 8C:
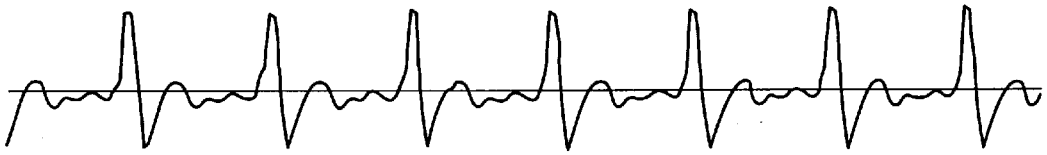
FIG. 8C is a view showing, by way of example, a waveform of an output signal from the signal processor.

FIG. 8A shows an example of the waveform of the main body-side vibration signal output from the main body-side pickup 20, FIG. 8B shows an example of the waveform of the bow-side vibration signal output from the bow-side pickup 10, and FIG. 8C shows an example of the waveform of a signal from the signal processor 103, which is processed based upon the main body-side vibration signal shown in FIG. 8A and the bow-side vibration signal shown in FIG. 8B by the signal processor 103. The waveform of FIG. 8C has been obtained in the case where the coefficients of the signal processor 103 are set as follows: CS=0 dB, MS=−5 dB, CMS=−96 dB, MMS=−96 dB, MR=−16 dB, OS=0 dB, and T=20 msec. Thus, the waveform of FIG. 8C does not reflect the result of mixing of the main body-side vibration signal and the bow-side vibration signal by the adder 305 at all, but only represents the waveform of a signal obtained by frequency-modulating the main body-side vibration signal with the bow-side vibration signal.

Thus, according to the present embodiment, the main body-side vibration signal is output after being frequency-modulated with the bow-side vibration signal. As a result, compared with the conventional electric violin in which musical tones are output based solely on the main body-side vibration signal, richer and more diverse expressions can be achieved in musical performance.

Further, since each of the coefficients used in the signal processor may be adjusted as desired by a user, musical tones suited to the user's taste can be output.

Next, a third embodiment of the present invention will be described.

An electric violin according to the third embodiment includes a signal processor 103' instead of the signal processor 103 of the electric violin according to the second embodiment described above. Since the other elements and parts are the same as in the second embodiment shown in FIG. 5, description and illustration thereof are omitted.

Figure 9:
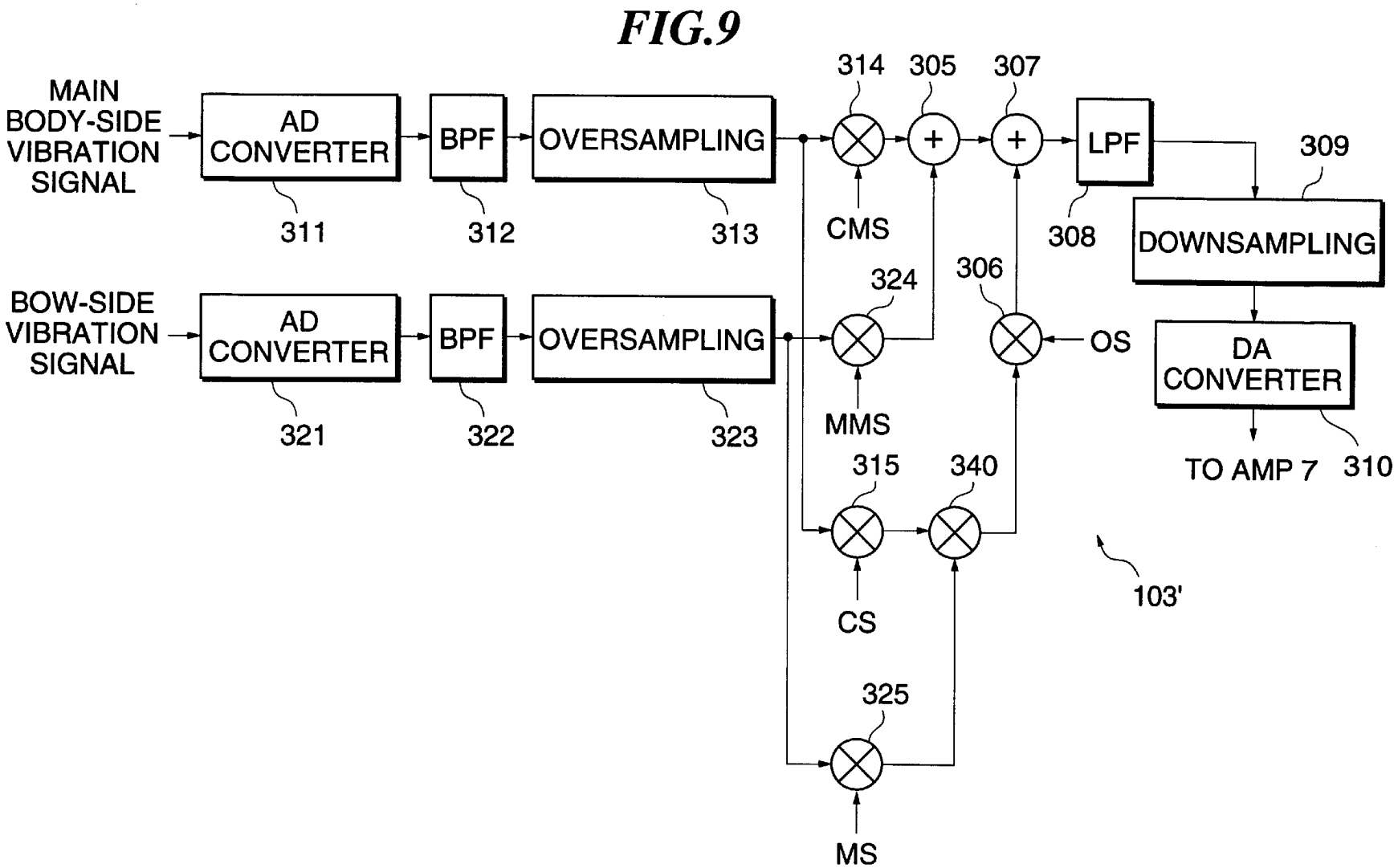
FIG. 9 is a block diagram showing the construction of a signal processor of an electric violin as an electric musical instrument according to a third embodiment of the present invention.

FIG. 9 shows the construction of the signal processor 103' of the electric violin according to the third embodiment. In FIG. 9, corresponding elements and parts to those of the signal processor 103 in FIG. 6 are designated by identical reference numerals, and description thereof is omitted.

The signal processor 103' has functions of multiplying the main body-side vibration signal by the bow-side vibration signal, adding the main body-side vibration signal and the bow-side vibration signal, and adding the result of the multiplication and the result of the addition and outputting the sum. More specifically, the signal processor 103' is constructed such that a multiplier 340 is provided instead of the divider 326, overflow limiter 327, multiplier 328, adders 329 and 330, address counter 302, selector 303, and memory 304 in the second embodiment described above. This multiplier 340 multiplies the output signals from the multipliers 315 and 325, and outputs the result to the multiplier 306.

The operation of the electric violin of the present embodiment will next be explained.

The main body-side vibration signal that is entered into the signal processor 103' is supplied via the A/D converter 311, the BPF 312 and the oversampling circuit 313 to the multipliers 314 and 315. The multiplier 314 multiplies the supplied signal by the coefficient CMS and outputs the result. The multiplier 315 multiplies the supplied signal by the coefficient CS and outputs the result.

On the other hand, the bow-side vibration signal that is entered into the signal processor 103' is supplied via the A/D converter 321, the BPF 322 and the oversampling circuit 323 to the multipliers 324 and 325. The multiplier 324 multiplies the supplied signal by the coefficient MMS and outputs the result. The adder 305 adds the output signal from the multiplier 324 and the output signal from the multiplier 314, described above, and outputs the result to the adder 307.

The multiplier 325 multiplies the signal supplied from the oversampling circuit 323 by the coefficient MS and outputs the result.

The multiplier 340 multiplies the output signal from the multiplier 325 by the output signal from the multiplier 315, described above, and outputs the result. This signal is multiplied by the coefficient OS at the multiplier 306, and the result is output to the adder 307.

The adder 307 adds the output signal from the multiplier 306 and the output signal from the adder 305, described above, and outputs the result. This output signal is output via the LPF 308, the downsampling unit 309 and the D/A converter 310 to the amplifier 7, to be finally output from the loudspeaker 8.

Figure 10A:
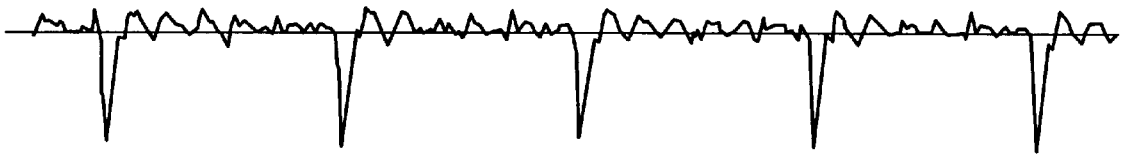
FIG. 10A is a view showing, by way of example, a waveform of a main body-side vibration signal generated by the electric violin according to the third embodiment.
Figure 10B:
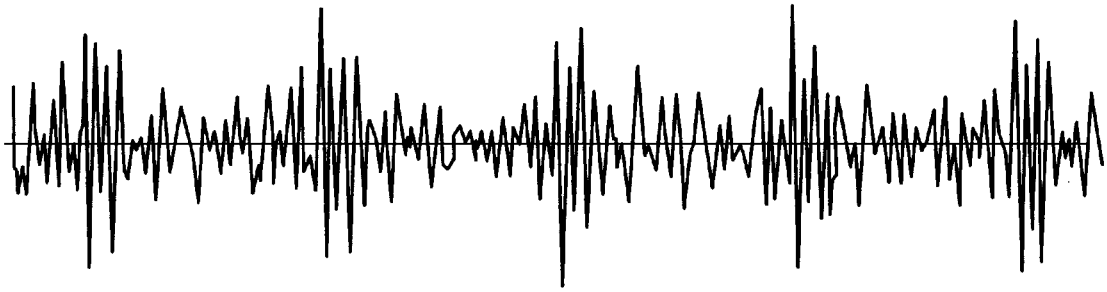
FIG. 10B is a view showing, by way of example, a waveform of a bow-side vibration signal generated by the electric violin according to the third embodiment.
Figure 10C:
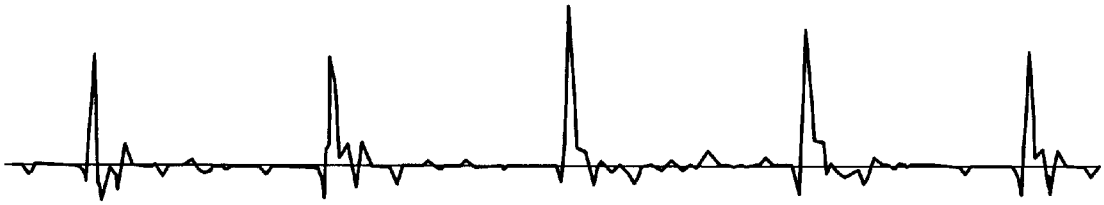
FIG. 10C is a view showing, by way of example, a waveform of an output signal from the signal processor of FIG. 9.

FIG. 10A shows an example of the waveform of the main body-side vibration signal output from the main body-side pickup 20, FIG. 10B shows an example of the waveform of the bow-side vibration signal output from the bow-side pickup 10, and FIG. 10C shows an example of the waveform of an output signal from the signal processor 103' which has been obtained based upon the main body-side vibration signal shown in FIG. 10A and the bow-side vibration signal shown in FIG. 10B input to the signal processor 103'. The signal of FIG. 10C has been obtained in the case where the coefficients of the signal processor 103 are set as follows: CS=0 dB, MS=0 dB, CMS=−96 dB, MMS=−96 dB, and OS=0 dB. Thus, the waveform of FIG. 10C does not reflect the result of mixing of the main body-side vibration signal and the bow-side vibration signal by the adder 305 at all, but only represents the waveform of a signal obtained by multiplying the main body-side vibration signal by the bow-side vibration signal.

Thus, according to the present embodiment, the main body-side vibration signal is output after being multiplied by the bow-side vibration signal. As a result, compared with the conventional electric violin in which musical tones are output based solely on the main body-side vibration signal, richer and more diverse expressions can be achieved in musical performance. Further, since each of the coefficients used in the signal processor 103' can be adjusted as desired by a user as in the second embodiment described above, musical tones suited to the user's taste can be output.

The foregoing description of the embodiments of the present invention is only illustrative, and various modifications and variations may be made to the above described embodiments without departing from the spirit and scope of the invention. For example, the following variations are possible.

In the second embodiment described above, the main body-side vibration signal is output after being frequency-modulated with the bow-side vibration signal. Conversely, the electric violin may be constructed such that the bow-side vibration signal is output after being frequency-modulated with the main body-side vibration signal. In this case, in FIG. 6, the signal processor 103 may be only modified such that the bow-side vibration signal is input to the A/D converter 311 while the main body-side vibration signal is input to the A/D converter 321.

The electric violin may be constructed such that a user can select which of the main body-side vibration signal and the bow-side vibration signal is to be used as the modulating signal (that is, the signal for generating the read address signal AR), and which of the two is to be used as the signal to be modulated (that is, the signal written into the memory 304). To this end, it is only necessary to provide a switch for selectively inputting each of the bow-side vibration signal output from the bow-side pickup 10 and the main body-side vibration signal output from the main body-side pickup 20 to either the A/D converter 311 or the A/D converter 321.

It is to be understood that although in the embodiments described above, the present invention is applied to an electric violin, the invention may be applied to any other musical instrument in which strings are caused to vibrate using a bow, for example, viola, cello, and contrabass.

The application of the present invention is not limited to musical instruments in which strings are caused to vibrate using a bow to produce musical tones. The present invention may be applied to any other musical instrument in which a tone generating source is driven using a driving member to produce musical tones. For example, the present invention may be applied to a drum in which a pad as a tone generating source is struck with a stick as a driving member. Then, the drum may be constructed such that besides the vibration of the pad corresponding to the tone generating source-side vibration signal, the vibration of the stick corresponding to the driving member-side vibration signal is also detected, and one signal is used to frequency-modulate the other signal, or alternatively, the two signals may be multiplied. Similarly, the present invention may be applied to a saxophone, a clarinet or the like in which a mouth piece as a tone generating source is caused to vibrate using a reed as a driving member. Then, the musical instrument may be constructed such that besides the vibration of the mouth piece corresponding to the tone-generating-source-side vibration signal, the vibration of the reed corresponding to the driving member-side vibration signal is also detected, and one signal is used to frequency-modulate the other signal, or alternatively, the two signals may be multiplied.

Although in the second and third embodiments described above, the main body-side vibration signal and the bow-side vibration signal are first converted to digital signals by the A/D converters 311 and 321 and then subjected to various processing (frequency modulation, multiplication of each signal, and so forth), various processing may be performed directly on these vibration signals in the form of analog signals.

According to the present invention, as described above, musical tones can be output which reflect the bow-side vibration signal corresponding to the vibration produced in the bow in addition to the main body-side vibration signal corresponding to the vibration produced in the strings. Therefore, compared with the conventional electric musical instrument such as electric violin, richer and more diverse expressions can be achieved in musical performance.

What is claimed is:

1. An electrical musical instrument comprising:

a tone generating source;

a driving member that drives said tone generating source;

a tone generating source-side signal generator that obtains a tone generating source-side signal from said tone generating source and outputs the obtained signal;

a driving member-side signal generator that generates a driving member-side signal representing vibration of said driving member and outputs the obtained signal, said vibration of said driving member being caused by the driving of said tone generating source by said driving member;

a modulation device that frequency-modulates one of said tone generating source-side signal and said driving member-side signal with the other of said tone generating source-side signal and said driving member-side signal and outputs the modulated signal; and an output device that outputs the modulated signal output from said modulation device as a sound.

2. An electric musical instrument as claimed in claim 1, wherein said modulation device comprises a memory that stores one of said tone generating source-side signal and driving member-side signal, and a reading device that generates an address signal based on the other of said tone generating source-side signal and driving member-side signal, and reads out the signal stored in said memory at an address designated by said address signal.

3. An electric musical instrument as claimed in claim 2, further comprising a first mixing device that mixes said tone generating source-side signal and said driving member-side signal and outputs the mixed signal, and a second mixing device that mixes the mixed signal output from said first mixing device and the modulated signal output from said modulation device and outputs the mixed signal, and wherein said output device outputs the mixed signal output from said second mixing device as a sound.

4. An electric musical instrument as claimed in claim 1, further comprising a first mixing device that mixes said tone generating source-side signal and said driving member-side signal and outputs the mixed signal, and a second mixing device that mixes the mixed signal output from said first mixing device and the modulated signal output from said modulation device and outputs the mixed signal, and wherein said output device outputs the mixed signal output from said second mixing device as a sound.

5. An electric musical instrument comprising:

a tone generating source;

a driving member that drives said tone generating source;

a tone generating source-side signal generator that obtains a signal from said tone generating source and outputs the obtained signal;

a driving member-side signal generator that generates a signal representing vibration of said driving member and outputs the obtained signal, said vibration of said driving member being caused by the driving of said tone generating source by said driving member;

a multiplier that multiplies the signal output from said tone generating source-side signal generator and the signal output from said driving member-side signal generator and outputs a signal indicative of the resulting product; and an output device that outputs the signal output from said multiplier as a sound.

6. An electric musical instrument as claimed in claim 5, further comprising a first mixing device that mixes the signal output from said tone generating source-side signal generator and the signal output from said driving member-side signal generator and outputs the mixed signal, and a second mixing device that mixes the mixed signal output from said first mixing device and the signal output from said multiplier and outputs the mixed signal, and wherein said output device outputs the mixed signal output from said second mixing device as a sound.

7. An electrical musical instrument comprising:

a tone generating source;

a driving member for driving said tone generating source;

a driving member-side signal generator for generating a driving member signal representing vibration of said driving member, said vibration of said driving member being caused by the driving of said tone generating source by said driving member; and a musical tone signal generator for generating a musical tone signal in accordance with said driving member signal.

8. An electric musical instrument as claimed in claim 7, wherein said tone generating source is an acoustic source for producing an acoustic sound by the driving of said tone generating source by said driving member.

9. An electric musical instrument as claimed in claim 7, wherein said musical tone signal generator comprises a first signal processor for performing a first processing on said driving member signal and for generating a first processed signal.

10. An electric musical instrument as claimed in claim 9, wherein said musical tone signal generator further comprises a second signal processor for performing a second processing on said first processed signal.

11. An electric musical instrument as claimed in claim 9, wherein said first processing is a modulating operation for modulating said driving member signal.

12. An electric musical instrument as claimed in claim 11, wherein said modulating operation is a frequency-modulating operation.

13. An electric musical instrument as claimed in claim 11, wherein said modulating operation is an amplitude-modulating operation.

14. An electric musical instrument as claimed in claim 7, wherein said musical tone signal generator comprises an electronic tone source for producing an electronic tone signal in accordance with said driving member signal.

15. An electric musical instrument as claimed in claim 14, wherein said musical tone signal generator further comprises a first signal processor for performing a first processing on said driving member signal and for generating a first processed signal.

16. An electric musical instrument as claimed in claim 15, wherein said musical tone signal generator further comprises a second signal processor for performing a second processing on said electronic tone signal and said first processed signal.

17. An electric musical instrument as claimed in claim 16, wherein said second processing is a mixing operation for mixing said electronic tone signal and said first processed signal.

18. An electric musical instrument as claimed in claim 7, wherein said tone generating source comprises a source signal generator for generating a source signal representing vibration of said tone generating source, said vibration of said tone generating source being caused by the driving of said tone generating source by said driving member, and said musical tone signal generator generates said musical tone signal in accordance with said source signal.

19. An electric musical instrument as claimed in claim 18, wherein said musical tone signal generator comprises a first signal processor for performing a first processing on at least one of said driving member signal and said source signal and for generating a first processed signal, said musical tone signal being formed in accordance with said first processed signal.

20. An electric musical instrument as claimed in claim 19, wherein said first processing is a mixing operation for mixing said driving member signal and said source signal.

21. An electric musical instrument as claimed in claim 19, wherein said first processing is a selecting operation for selecting one from among at least said driving member signal and said source signal.

22. An electric musical instrument as claimed in claim 19, wherein said first processing is a modulating operation for modulating one of said driving member signal and said source signal.

23. An electric musical instrument as claimed in claim 22, wherein said modulating operation is a frequency-modulating operation.

24. An electric musical instrument as claimed in claim 22, wherein said modulating operation is an amplitude-modulating operation.

25. An electric musical instrument as claimed in claim 18, wherein said musical tone signal generator comprises an electronic tone source for producing an electronic tone signal in accordance with at least one of said driving member signal and said source signal.

26. An electric musical instrument as claimed in claim 25, wherein said musical tone signal generator further comprises a first signal processor for performing a first processing on at least one of said driving member signal and said source signal and for generating a first processed signal, and a second signal processor for performing a second processing based on said electronic tone signal and said first processed signal.

27. An electric musical instrument as claimed in claim 26, wherein said second processing is a mixing operation for mixing said electronic tone signal and said first processed signal.

28. An electric musical instrument comprising:

a tone generating source;

a driving member that drives said tone generating source;

a tone generating source-side signal generator that obtains a tone generating source-side signal from said tone generating source and outputs the obtained signal;

a driving member-side signal generator that obtains a driving member-side signal from said driving member and outputs the obtained signal;

a modulation device that frequency-modulates one of said tone generating source-side signal and said driving member-side signal with the other of said tone generating source-side signal and said driving member-side signal and outputs the modulated signal, wherein said modulation device comprises a memory that stores one of said tone generating source-side signal and driving member-side signal, and a reading device that generates an address signal based on the other of said tone generating source-side signal and driving member-side signal, and reads out the signal stored in said memory at an address designated by said address signal; and an output device that outputs the modulated signal output from said modulation device as a sound.

29. An electric musical instrument comprising:

a tone generating source;

a driving member that drives said tone generating source;

a tone generating source-side signal generator that obtains a tone generating source-side signal from said tone generating source and outputs the obtained signal;

a driving member-side signal generator that obtains a driving member-side signal from said driving member and outputs the obtained signal;

a modulation device that frequency-modulates one of said tone generating source-side signal and said driving member-side signal with the other of said tone generating source-side signal and said driving member-side signal and outputs the modulated signal;

a first mixing device that mixes said tone generating source-side signal and said driving member-side signal and outputs the mixed signal;

a second mixing device that mixes the mixed signal output from said first mixing device and the modulated signal output from said modulation device and outputs the mixed signal; and an output device that outputs the mixed signal output from said second mixing device as a sound.

30. An electric musical instrument comprising:

a tone generating source;

a driving member that drives said tone generating source;

a tone generating source-side signal generator that obtains a tone generating source-side signal from said tone generating source and outputs the obtained signal;

a driving member-side signal generator that obtains a driving member-side signal from said driving member and outputs the obtained signal;

a modulation device that frequency-modulates one of said tone generating source-side signal and said driving member-side signal with the other of said tone generating source-side signal and said driving member-side signal and outputs the modulated signal, wherein said modulation device comprises a memory that stores one of said tone generating source-side signal and driving member-side signal, and a reading device that generates an address signal based on the other of said tone generating source-side signal and driving member-side signal, and reads out the signal stored in said memory at an address designated by said address signal;

a first mixing device that mixes said tone generating source-side signal and said driving member-side signal and outputs the mixed signal;

a second mixing device that mixes the mixed signal output from said first mixing device and the modulated signal output from said modulation device and outputs the mixed signal; and an output device that outputs the mixed signal output from said second mixing device as a sound.

31. An electric musical instrument comprising:

a tone generating source;

a driving member that drives said tone generating source;

a tone-generating source-side signal generator that obtains a signal from said tone generating source and outputs the obtained signal;

a driving member-side signal generator that obtains a signal from said driving member and outputs the obtained signal;

a multiplier that multiplies the signal output from said tone generating source-side signal generator and the signal output from said driving member-side signal generator and outputs a signal indicative of the resulting product;

a first mixing device that mixes the signal output from said tone generating source-side signal generator and the signal output from said driving member-side signal generator and outputs the mixed signal;

a second mixing device that mixes the mixed signal output from said first mixing device and the signal output from said multiplier and outputs the mixed signal; and an output device that outputs the mixed signal output from said second mixing device as a sound.

* * * * *